United States Patent [19]

Warax

[11] 4,375,705

[45] Mar. 8, 1983

[54] REMOTE STORAGE SPITTOON

[76] Inventor: Earnest R. Warax, P.O. Box 111, Jacksboro, Tenn. 37757

[21] Appl. No.: 265,145

[22] Filed: May 19, 1981

[51] Int. Cl.[3] ..... A61J 19/00

[52] U.S. Cl. ..... 4/271; 4/258

[58] Field of Search ..... 4/258, 267, 271, 284, 4/285; 220/69; 248/1, DIG. 10; 206/223

[56] References Cited

U.S. PATENT DOCUMENTS

| | | | |
|---|---|---|---|
| 1,210,428 | 1/1917 | Crisler | 4/258 |
| 1,962,760 | 6/1934 | Burk | 206/223 |
| 3,471,114 | 10/1969 | Ball | 220/69 |
| 3,798,682 | 3/1974 | Harreld | 4/258 |
| 4,218,787 | 7/1980 | Puckett | 4/258 |

*Primary Examiner*—Stephen Marcus
*Assistant Examiner*—Kenneth S. Putnam
*Attorney, Agent, or Firm*—Harvey B. Jacobson

[57] ABSTRACT

An upwardly opening receiver, a receptacle and a conduit are provided with the upwardly opening receiver including a downwardly tapering lower portion opening downwardly into one end of the conduit and the second end of the conduit opening downwardly into the receptacle. A weighted hollow body including a removably closable fluent weight material inlet and outlet opening is provided and the weighted body is removably supported about the bottom of the receptable for preventing unwanted tipping of the receptacle. the receptable is generally upright cylindrical in configuration and the weighted base comprises an annular body encircling and closely embracing the lower portion of the receptacle. The upper portion of the receptacle includes a removable closable cud receiving opening therein and clamp structure is also provided for clampingly engaging the arm of an arm equipped piece of seating furniture. The upper portion of the receiver further includes a hook and the clamp structure includes a hook engageable portion with which the hook on the receiver may be removably engaged for support of the receiver from the clamp structure after the latter has been clamped engaged with the arm of an arm equipped piece of seating furniture.

6 Claims, 9 Drawing Figures

REMOTE STORAGE SPITTOON

BACKGROUND OF THE INVENTION

Various forms of remote storage spittoons heretofore have been provided such as those disclosed in U.S. Pat. Nos. 317,038, 630,225, 923,192, 935,508 and 1,210,428. However, these previously known forms of spittoons do not include all of the features of the instant invention wherein the spittoon of the instant invention may be conveniently utilized in a variety of different environments.

The main object of this invention is to provide a remote storage spittoon which may be utilized in different environments and which includes a carrying case therefor whereby the spittoon may be carried from place-to-place and used whenever desired.

Still another object of this invention is to provide a spittoon constructed in a manner whereby the receptacle portion thereof is equipped with a removably closable cud receiving opening.

Still another important object of this invention is to provide a remote spittoon including a receptacle having a removable weighted base operatively associated therewith for supporting the receptacle portion in a steady manner against upset.

Another object of this invention is to provide a spittoon including a receiver portion may be suspended from a suitable support structure and also including a clamp structure which may be engaged with a suitable support structure such as the arm of a chair and from which the receiver portion may be removably hook supported.

A final object of this invention to be specifically enumerated herein is to provide a spittoon in accordance with the preceding object and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 3:
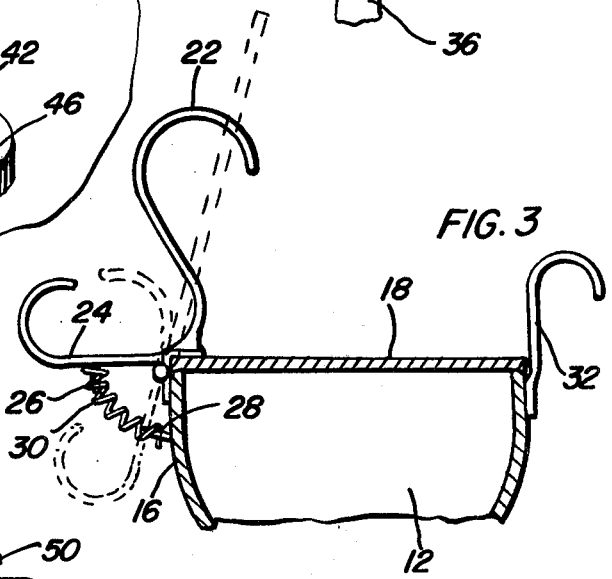
FIG. 3 is a enlarged fragmentary vertical sectional view taken substantially upon the plane indicated by the section line 3—3 of FIG. 2.

Referring now more specifically to the drawings, the numeral 10 generally designates the remote spittoon of the instant invention. The remote spittoon includes an upwardly opening receiver 12 including a downwardly tapering lower portion 14 and an upwardly opening upper portion 16 removably closed by a hinged cover 18. The upper portion 16 of the receiver 12 is generally circular in plan shape and the cover 18 is also circular and has one peripheral portion thereof hingedly supported from a corresponding peripheral portion of the upper portion 16 by a hinge 20. In addition, the cover 18 includes a hook 22 stationarily supported therefrom and the hook 22 includes a horizontally outwardly directed portion 24 which may be downwardly depressed to swing the cover 18 from the closed position thereof illustrated in solid lines in FIG. 3 to the phantom line position thereof illustrated in FIG. 3. The portion 24 includes a downwardly projecting pin portion 26 and the upper portion 16 includes a horizontally owtwardly projecting pin portion 28. An expansion spring 30 is slightly compressed and has its opposite ends telescoped over the pin portions 26 and 28. Accordingly, the compression spring 30 yieldingly biases the cover 18 toward its closed position illustrated in solid lines in FIG. 3.

In addition, the receptacle 12 includes a stationary hook 32 supported therefrom on the side of the upper portion 16 remote from the hinge 20 and either of the hooks 22 and 32 may be engaged with a suitable hook engageable support for support of the receptacle 12 in elevated position.

The downwardly tapering lower portion 14 of the receptacle 12 opens into the upper end of a flexible conduit 36 and the lower end of the flexible conduit 36 opens downwardly through the central portion 38 of a threaded closure cap 40 provided on an upright cylindrical receptacle 42. The lower end of the receptacle 42 is snugly encircled by a hollow annular base 44 having a closure cap equipped fluent weight material inlet and outlet opening 46 thereon and the base 44 defines a hollow interior 48 into which any suitable fluent weight material may be admitted through the opening 46. Of course, the base 44 assists in maintaining the receptacle 42 upright when the receptacle 42 is supported from a suitable horizontal support surface.

Figure 1:
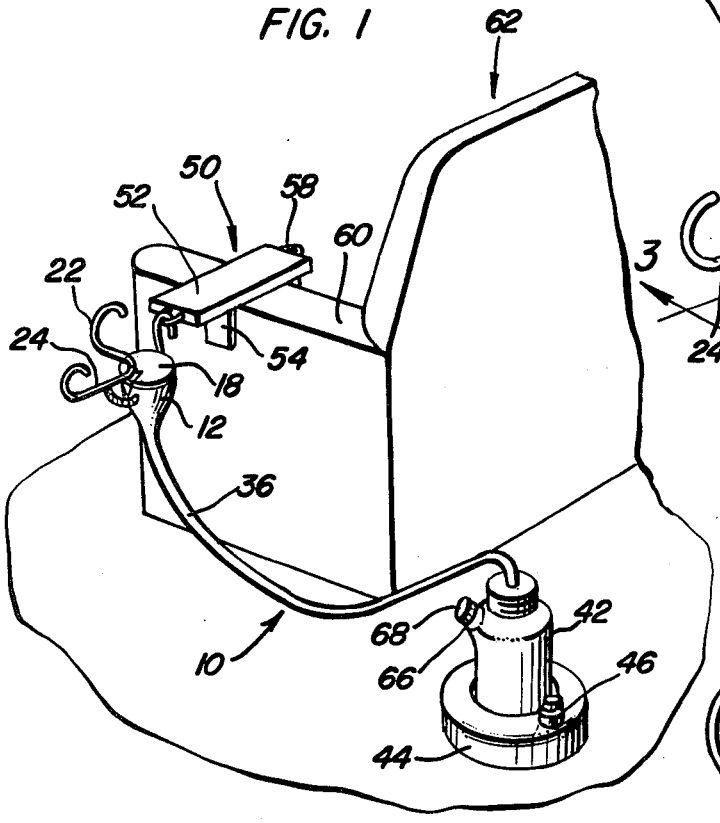
FIG. 1 is a perspective view of the remote storage spittoon in operative association with an armchair.
Figure 2:
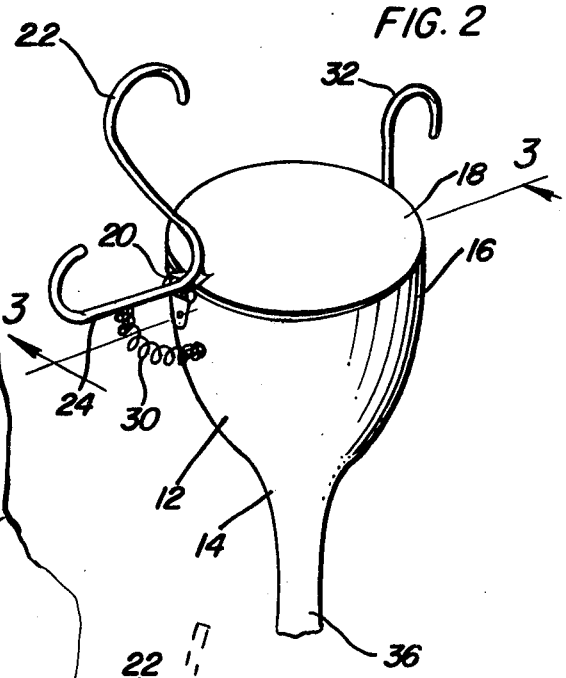
FIG. 2 is an enlarge perspective view of the receiver portion of the spittoon.
Figure 4:
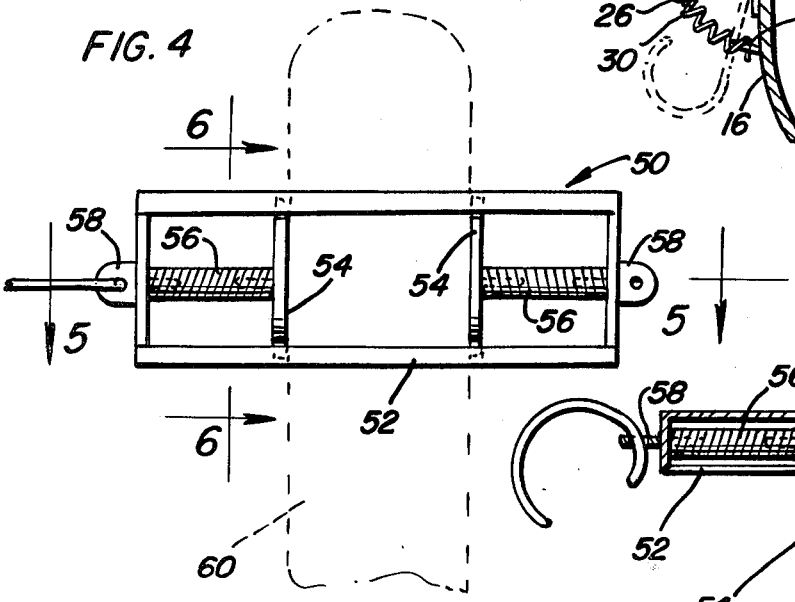
FIG. 4 is a bottom plan view illustrating a furniture arm engaging clamp portion of the invention.
Figure 5:
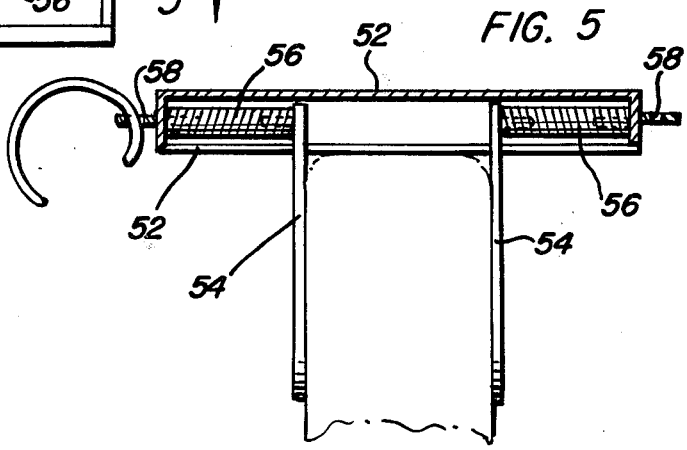
FIG. 5 is a fragmentary vertical sectional view taken substantially upon the plane indicated by the section line 5—5 of FIG. 4.
Figure 7:
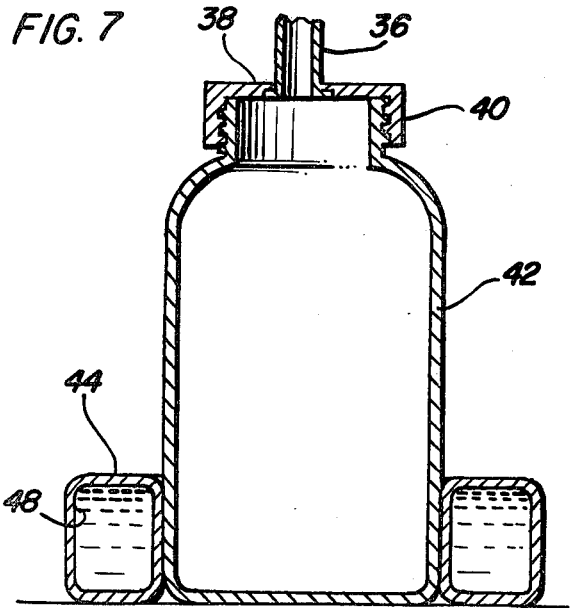
FIG. 7 is an enlarged fragmentary vertical sectional view of the receptacle and weighted base portion of the invention.
Figure 6:
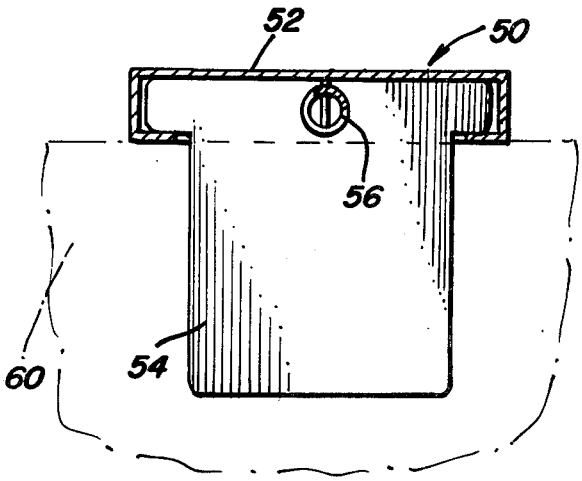
FIG. 6 is an enlarged fragmentary transverse vertical sectional view taken substantially upon the plane indicated by the section line 6—6 of FIG. 4.

Referring now more specifically to FIGS. 1, 4 and 5 of the drawings, there may be seen a clamp assembly referred to in general by the reference numeral 50. The clamp assembly 50 includes a rectangular frame 52 from which a pair of clamp plates 54 are guidingly supported with the guide plates 54 projecting outwardly from one side of the frame 52. A pair of compression springs 56 are operatively connected between the clamp plates 54 and the frame 52 and yieldingly bias the clamp plates 54 toward each other. The opposite ends of the frame 52 include apertured mounting ears 58 with which either the hook 22 or the hook 32 may be removably engaged.

As illustrated in FIGS. 1, 4 and 5 of the drawings, the clamp assembly 50 may be readily clampingly engaged with the arm 60 of a chair 62 and the receiver 12 may be suspended from the clamp assembly 50.

The receptacle 42 includes an outwardly projecting inlet neck 66 on its upper end removably closed by means of a threaded cap 68 and the cap 68 may be removed in order to enable the user of the spittoon 10 to deposit cuds into the receptacle 42 through the inlet neck 66.

Figure 8:
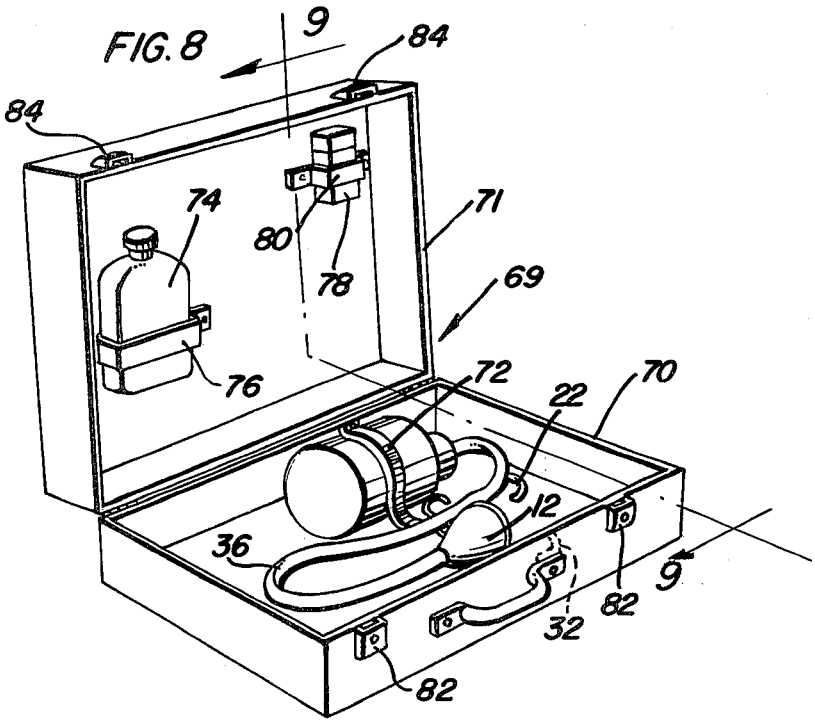
FIG. 8 is a perspective view of a carrying case for the invention.
Figure 9:
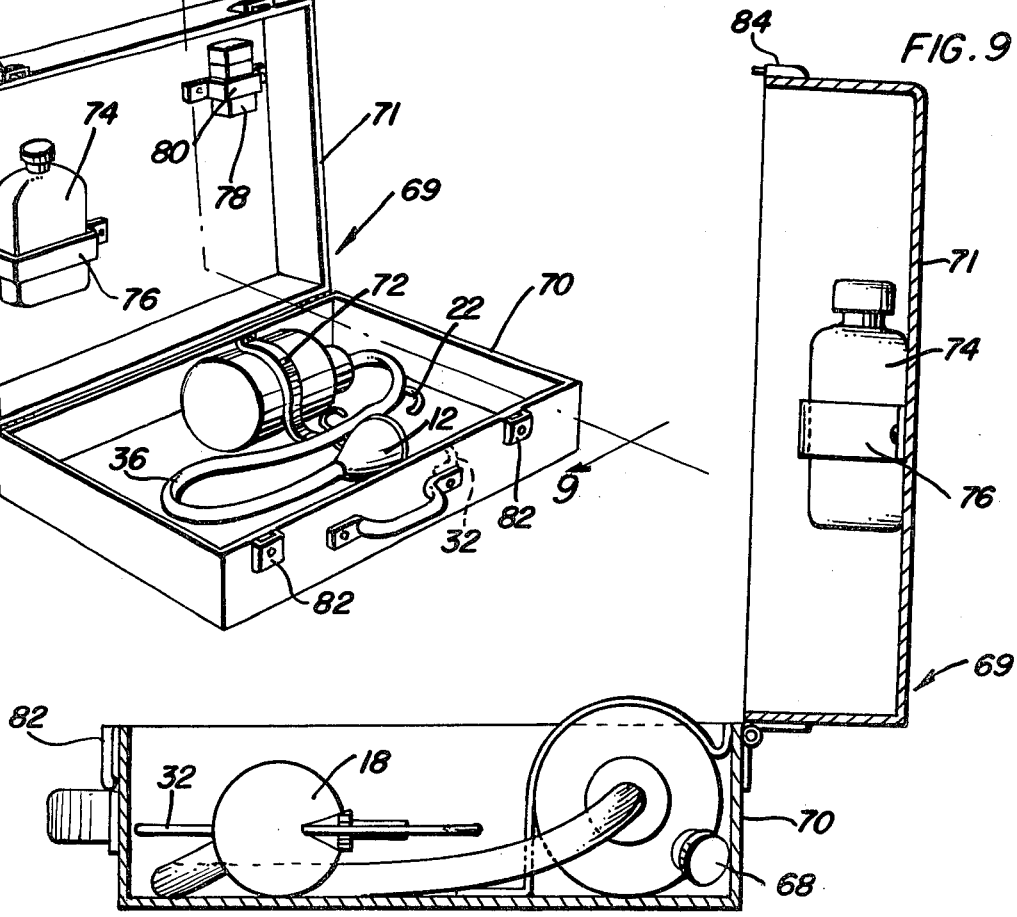
FIG. 9 is an enlarged vertical sectional view taken substantially upon the plane indicated by the section line 9—9 of FIG. 8.

Further, with attention directed more specifically to FIGS. 8 and 9 of the drawings, there may be seen a carrying case referred to in general by the reference numeral 69. The carrying case 69 includes an upwardly opening bottom portion 70 and downwardly opening cover 71 hingedly supported from the bottom portion 70. A strap 72 is provided in the bottom portion 70 for supporting receptacle 42 in stationary position within the bottom portion 70 and the bottom portion 70 of the carrying case 69 may also receive the receiver 12 and conduit 36 therein. In addition, the base 44 may also be received within the bottom portion 70 of the carrying case 69. The interior of the cover 71 of the case 69 includes a canteen 74 removably supported therein by a suitable strap 76 and a toothpick container 78 removably supported therein by a strap 80. Of course, when the cover 70 is swung to the closed position, it may be latched in the closed position by suitable latch components 82 supported from the base portion 68 and latch components 84 supported from the cover 70.

It will be noted that the receiver 12 and conduit may be integrally formed of relatively stiff plastic of different thicknesses, or separately formed of any suitable materials and thereafter joined together. Further, the upper surface 86 of the frame 52 may be roughened and imperforate for supporting various articles, like drink containers, thereon. Also, the carrying case may be of such size to receive various additional articles therein.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A remote storage spittoon including an upwardly opening receiver, a flexible conduit including first and second ends and a receptacle, said receiver including a downwardly tapering lower portion opening downwardly into said first end of said conduit, the second end of said conduit opening downwardly into said receptacle, said receptacle including a weighted base removably supported therefrom, a clamp assembly including opposing jaw members relatively mounted for movement toward and away from each other and adapted to rest upon and clampingly engage the arm of an arm equipped piece of seating furniture, means yieldingly biasing said jaw members together, the upper portion of said receiver including hook means supported therefrom, said clamp structure including a portion thereof adapted to be hook engaged by said hook means.

2. The spittoon of claim 1 wherein said weighted base includes a hollow body and said body includes a removably closable fluent weight material inlet and outlet openings through which fluent weight material may be added to and removed from said hollow body.

3. The spittoon of claim 2 wherein said receptacle is generally upright cylindrical in configuration and said weighted base includes a hollow annular body encircling and closely embracing the lower portion of said receptacle.

4. The spittoon of claim 1 wherein said upwardly opening receiver includes a hinged cover therefor swingable between closed and open positions closing and opening the upper portion of said receiver, and spring means operably connected between said cover and said receiver yieldingly biasing said cover toward the closed position thereof.

5. A remote storage spittoon including an upwardly opening receiver, a flexible conduit including first and second ends and a receptacle, said receiver including a downwardly tapering lower portion opening downwardly into said first end of said conduit, said second end of said conduit opening downwardly into said receptacle, a clamp assembly including opposing jaw members relatively mounted for movement toward and away from each other and adapted to rest upon and clampingly engage the arm of an arm equipped piece of seating furniture, means yieldingly biasing said jaw members together, the upper portion of said receiver including hook means supported therefrom, said clamp structure including a portion thereof removably hook engageable by said hook means.

6. A remote storage spittoon including an upwardly opening receiver, a flexible conduit including first and second ends and a receptacle, said receiver including a downwardly tapering lower portion opening downwardly into said first end of said conduit, the second end of said conduit opening downwardly into said receptacle, said receptacle including a weighted base removably supported therefrom, a carrying case for receiving therein said receiver, said conduit and said receptacle, said carrying case also housing a removable canteen and a removable toothpick container.

* * * * *